United States Patent [19]

Iyer et al.

[11] Patent Number: 4,723,589

[45] Date of Patent: Feb. 9, 1988

[54] METHOD FOR MAKING VACUUM INTERRUPTER CONTACTS BY SPRAY DEPOSITION

[75] Inventors: Natraj C. Iyer, Monroeville; Alan T. Male, Murrysville, both of Pa.

[73] Assignee: Westinghouse Electric Corp., Pittsburgh, Pa.

[21] Appl. No.: 864,611

[22] Filed: May 19, 1986

[51] Int. Cl.[4] ..... B22D 23/00

[52] U.S. Cl. ..... 164/46; 427/34

[58] Field of Search ..... 164/46, 61, 65; 427/34, 427/423

[56] References Cited

U.S. PATENT DOCUMENTS

| | | | |
|---|---|---|---|
| 3,112,539 | 12/1963 | Barker | 164/46 |
| 3,490,116 | 1/1970 | Cape | 164/46 X |
| 3,742,585 | 7/1973 | Wentzell | 164/46 X |
| 3,865,173 | 2/1975 | Rohrberg | 164/46 |
| 4,328,257 | 5/1982 | Muehlberger et al. | 427/34 |
| 4,447,466 | 5/1984 | Jackson et al. | 427/34 |
| 4,574,451 | 3/1986 | Smashey et al. | 164/46 X |

FOREIGN PATENT DOCUMENTS

| | | | |
|---|---|---|---|
| 1299969 | 7/1969 | Fed. Rep. of Germany | 427/34 |
| 3,509,022 | 11/1985 | Fed. Rep. of Germany | 427/34 |
| 2498123 | 7/1982 | France | 427/34 |
| 58-50172 | 3/1983 | Japan | 164/61 |

OTHER PUBLICATIONS

Savage, S. J. et al., "Production of Rapidly Solidified Metals and Alloys", in *Journal of Metals*, vol. 36, No. 4, Apr. 1984, p. 26.

*Primary Examiner*—Nicholas P. Godici
*Assistant Examiner*—J. Reed Batten, Jr.
*Attorney, Agent, or Firm*—C. L. Menzemer

[57] ABSTRACT

A low pressure plasma or laser spray metal deposition process for the manufacture of a vacuum interrupter contact with a tailored composition gradient through the thickness of the contact.

5 Claims, 2 Drawing Figures

METHOD FOR MAKING VACUUM INTERRUPTER CONTACTS BY SPRAY DEPOSITION

FIELD OF THE INVENTION

1. Field of the Invention:

The present invention is in the field of vacuum type circuit interrupters and is specifically concerned with the use of a low pressure plasma or laser spray metal deposition process for the manufacture of the electrical contacts employed in such vacuum type circuit interrupters.

2. Description of the Prior Art:

Contacts or electrodes for vacuum interrupters have been made by casting and by powder metallurgical techniques.

Arc plasma guns have been used to apply coatings to metal parts. However, such coatings have not had the high density, or been free enough of oxides or thick enough to be used as contacts or electrodes in a vacuum interrupter.

SUMMARY OF THE INVENTION

The present invention is directed to a method or process for preparing an electrical contact or electrode for use in a vacuum interrupter comprising: disposing a mold of a predetermined configuration and cross-section into a chamber, establishing a predetermined ambient within the chamber, establishing a plasma within a plasma gun, said plasma gun being positioned to discharge into said chamber, feeding predetermined quantities of preselected metal powders including refractory metals into said plasma gun, said metals may be in the form of pure metals or in alloy form, entraining said metal powders within said plasma, whereby said metal powders are discharged from said plasma gun, entrained in said plasma, at a high velocity and impact and solidify upon said mold.

DESCRIPTION OF THE DRAWINGS

For a better understanding of the present invention, reference should be had to the following detailed discussion and drawings in which.

DESCRIPTION OF THE PREFERRED EMBODIMENT

Figure 1:
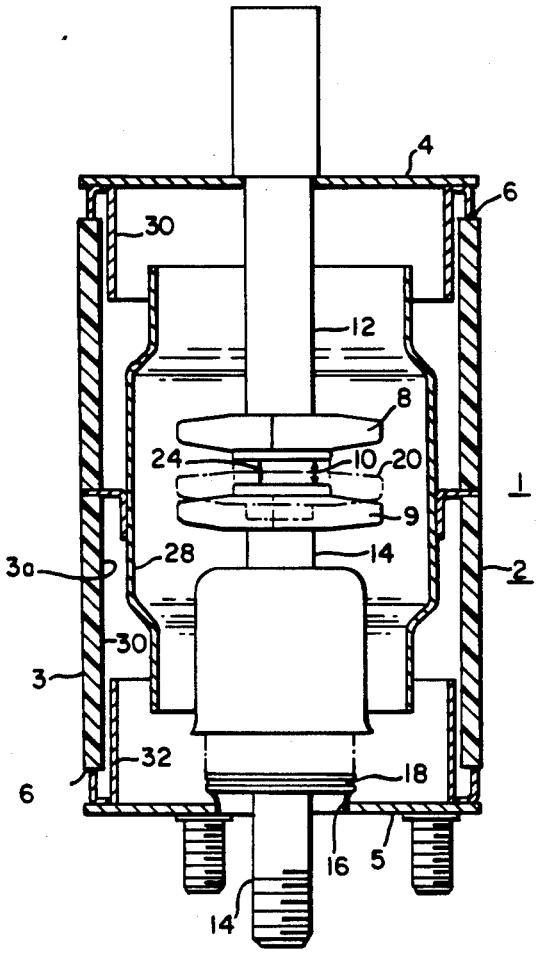
FIG. 1 is a vertical sectional view of a vacuum type circuit interrupter with the contacts being illustrated in the fully open circuit position.

With reference to FIG. 1, there is shown a typical vacuum type circuit interrupter generally designated by the reference numeral 1.

The vacuum circuit interrupter 1 has a highly evacuated envelope 2 comprising a casing 3 of suitable insulating material, and a pair of metallic end caps 4 and 5, closing off the ends of the case 2. Suitable seals 6 are provided between the end caps and the casing 3 to render the envelope vacuum-tight. The normal pressure within the envelope 2, under static conditions, is lower than $10^{-4}$ torr; so that reasonable assurance is had that the mean-free path for electrons will be longer than the potential breakdown paths within the envelope 2.

Located within the envelope 2 is a pair of relatively movable contacts, or electrodes 8 and 9, shown in full lines in FIG. 1 in their separated or open-circuit position.

The contacts or electrodes 8 and 9 are normally comprised of from 40% to 80% by weight copper and from 60% to 20%, by weight, chromium.

When the contacts 8 and 9 are separated, there is an arcing gap 10 located therebetween. The upper contact 8 is a stationary contact suitably secured to a conductive rod, or stem 12, which at its upper end is united to the upper end cap 4. The lower contact 9 is a movable contact joined to a conductive operating rod, or stem 14, which is suitably mounted for movement. The operating rod 14 projects through an opening 16 in the lower end cap 5, and a flexible metallic bellows 18 provides a seal about the rod, or stem 14, to allow for movement of the rod without impairing the vacuum inside the envelope 2. As shown in FIG. 1, the bellows 18 is secured in sealng relationship at its respective opposite ends to the operating rod 14 and to the lower end cap 5.

Coupled to the lower end of the operating rod 14, suitable actuating means (not shown) are provided for driving the movable contact 9 upwardly into engagement with the stationary contact 8, so as to close the circuit through the interrupter 1. The closed position of the movable contact is indicated by the dotted lines 20. The actuating means is also capable of returning the contact 9 to its illustrated solid-line open position, so as to open the circuit through the interrupter 1. A circuit-opening operation will, for example, entail a typical gap length, when the contacts 8 and 9 are fully separated, of perhaps ½ inch.

The arc, indicated at 24, that is established across the gap 10 between the electrodes 8 and 9, as the electrodes are opened, and also when they are closed, vaporizes some of the contact material, and these vapors are dispersed from the arcing gap 10 towards the envelope 2. In the illustrated interrupter 1, the internal insulating surfaces 3a of the casing 3 are protected from the condensation of arc-generated metallic vapor and particles thereon by means of a tubular metallic shield 28 suitably supported upon the casing 3, and preferably isolated from both end caps 4 and 5. This shield 28 acts to intercept and to condensate arc-generated metallic vapors before they can reach the casing 3. To reduce the chances of vapor bypassing the shield 28, a pair of end shields 30 and 32 are provided at opposite ends of the central shield 28.

The vapor shield 28 may be of either the electrically floating type or the non-floating type.

The contacts 8 and 9 are usually one of three types: (1) copper-chromium, 40% to 80% by weight copper and 60% to 20%, by weight, chromium; (2) copper-bismuth with bismuth being about 0.5%, by weight, or (3) a copper-chromium-bismuth composition 40% to 80%, by weight, copper, 60% to 20%, by weight, chromium and about 0.5%, by weight, bismuth.

The most common contact is the copper-chromium contact.

Such contacts contain a relatively high percentage of chromium in order to satisfy the anti-welding property requirement for the contact.

Currently contacts are made by casting techniques and by powder metallurgical techniques.

The chromium content of the contact is actually required only at the arcing surface region of the contact. However, neither casting nor powder metallurgical techniques now available allow for the rapid manufacture of contacts with a tailored composition, i.e., with the chromium concentrated at the contact surface.

The present invention teaches the use of a low pressure plasma spray or laser spray deposition technique for the manufacture of vacuum interrupter contacts or electrodes with a tailored composition.

In principle, plasma or laser spray deposition is a process in which metal, as for example copper, chromium and alloys thereof, particles liquefied from powder are deposited onto a substrate or mold. The solidification rate of the deposited liquefied metal particles is $\sim 10^4$ to $10^{6°}$ /sec. The composition of the deposit can be varied by varying the initial metal powder feed. The deposits obtained are near-full density and are in microcrystalline form. The chromium dispersion is fine.

In accordance with the teachings of this invention, the copper and chromium powder, or any desired binary or ternary alloy system powders, is fed into a plasma gun in stoichiometric proportions. The particles are spray deposited into or onto a metallic or ceramic mold of a predetermined shape.

As the deposition proceeds, the percentage of chromium, chromium being present as pure chromium or as a chromium alloy, in the powdered feed can be altered so as to obtain a tailored composition gradient through the thickness of the contact or electrode.

If laser deposition is used, the powder is fed directly into the mold while the laser heat source melts and densifies the powder compact. The deposit is then stripped from the mold and machined.

Figure 2:
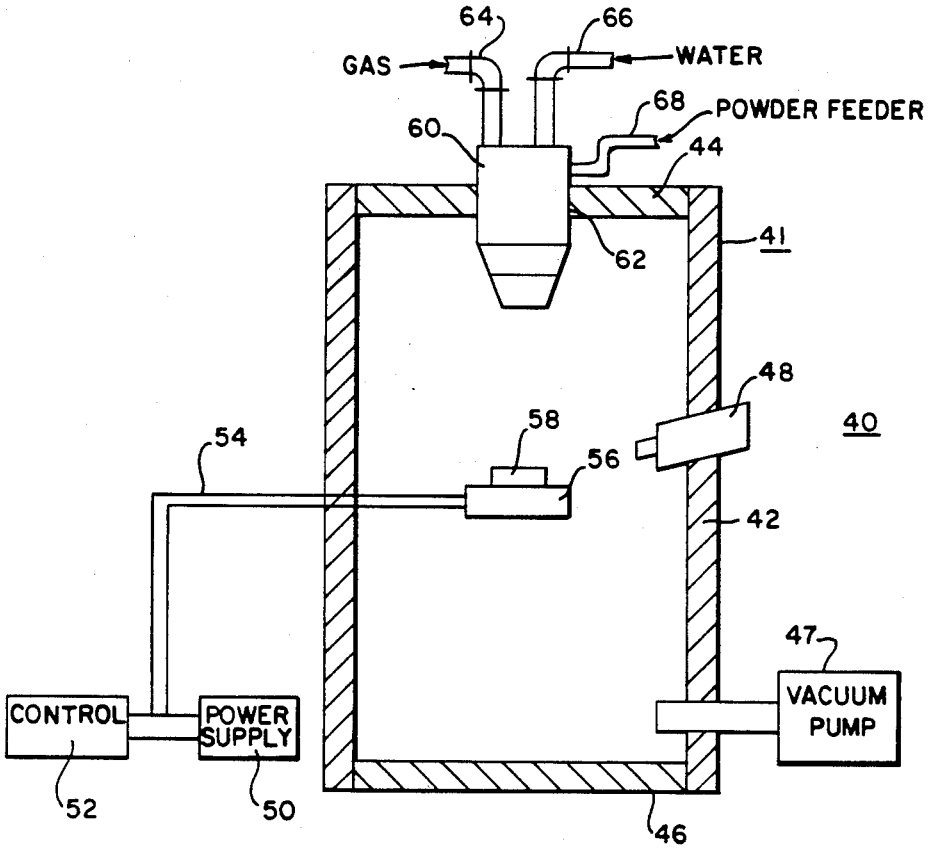
FIG. 2 is a schematic diagram of apparatus used to practice the teachings of this invention.

With reference to FIG. 2, there is shown schematically apparatus 40 for practicing the teachings of the present invention.

The apparatus 40 is comprised of a chamber or tank 41 normally of stainless steel. The tank 41 has side walls 42 and a top 44 and a bottom 46. The side walls 42 and top 44 and bottom 46 are of sufficient thickness so as not to be distorted when a vacuum is formed in the tank 41. There is a vacuum pump 47 which is employed to form a vacuum within the tank 41.

A viewport 48 is disposed within sidewall 42 to allow observation of the operation being carried out within the tank 41.

A power supply 50 and a control console 52 are employed to activate and control a manipulator 54 and a three-axis table 56 on which a mold 58 is positioned within the tank 41. The manipulator 54 controls the three-axis table 56.

A plasma gun or spray torch 60 is positioned through an aperture 62 in the top surface 44 of the tank 41. The gun or torch 60 has a gas inlet tube 64, a water inlet tube 66 and a powder inlet tube 68.

An example of a suitable plasma gun or spray torch is the commercially availabe Metco Plasma Flame Spray Gun 7MAr/H2 gun or the EPI Ar/HE plasma gun.

The gun 60 may be attached to a numerically controlled manipulator not shown to facilitate movement in spherical co-ordinates during the deposition process.

In practicing the teachings of this invention the mold 58 is prepared in a predetermined shape and of a predetermined cross-section.

The mold 58 may be of metal as for example of copper or steel, of ceramic, as for example alumina or boron nitride or of a leachable salt, as for example sodium chloride.

The invention will be described using a copper mold.

The mold 58 is cleaned and conditioned usually by one or more of the following operations, vapor degreasing, dry or wet grit blasting, water flushing and ultrasonic cleaning.

The mold 58 is then loaded into the tank 41 and positioned on the manipulator controlled three-axis table 56.

The vacuum pump 47 is activated and the tank 41 is evacuated to from 10 to 120 torr.

The plasma gun 60 is activated, using argon or nitrogen and helium or hydrogen, by ionizing the gases with an electric arc within the gun and the resulting plasma is used to heat the mold 58 to a temperature of from 700° C. to 900° C. This temperature range is employed for metal or ceramic molds. If a leachable salt mold is employed, the mold is not heated.

The diameter of the plasma beam can be varied from $\frac{3}{8}$-inch to 4 inches in diameter depending on the size of the mold.

Pure metal or metal alloy powder or powders, as for example copper and chromium powder, is fed into the gun through the powder feeder 68 in gun 60 in the correct stoichiometric proportion, at a rate of from 50 to 200 gms/minute. The powders are entrained in the gas plasma, which as pointed out above, is formed by ionizing two gases with an electric arc within the gun. The power level within the gun is from 30 kW to 80 kW.

The plasma temperature within the gun reaches approximately 10,000° K. and results in a rapid increase in gas volume within the gun. As a result, the plasma gas with the entrained molten metal powder particles exit the gun at a velocity which can be as high as MACH-3.

The molten metal powder particles entrained within the plasma impact upon the mold which is located from 20 cm to 60 cm from the plasma gun.

The molten metal particles upon impact with the mold solidify and form a splat. By use of the control console 52, the manipulator 54, the three-axis table 56 and, if used a numerically controlled manipulator for the gun, the mold is coated to a desired configuration and thickness with the copper-chromium mixture resulting in a full density electrical contact or electrode. By controlling the metal powder feed, the cross-section of the contact has the desired metal composition. That is for example, the contacting surface of the contact can be made with a higher concentration of chromium than the remainder of the contact.

A variation of the process can be used to fabricate copper chromium contacts with the addition of low boiling point metals such as bismuth or lithium.

In such a modification, the ternary powder, for example bismuth is introduced into the accelerating plasma in mid-stream. This prevents the boiling off of the relatively lower boiling point bismuth.

In this modification, the distance between the gun and the mold is from 50 cm to 75 cm.

If a laser gun is employed, the powder or powders are fed directly into the mold and the laser is used to melt and densify the powder compact.

The present invention offers many benefits over prior art techniques. Included among the benefits is the fact that contacts fabricated using this process are fabricated to almost the exact size and shape of the finished contact or electrode thus reducing the amount of machining required and conserving critical materials such as for example chromium.

The contact has a predetermined tailored composition as a result of controlling and modifying the stoichiometry of the powder feed.

As a result of carrying the process out in a vacuum, the contacts are gas free.

The cooling rate of the deposited splats is very high, about $10^5$ to $10^6$° C./sec., thus the microstructures of the contacts are ultrafine and cellular with a high degree of microhomogeneity. The resulting product has superior mechanical properties and exhibits improved dielectric characteristic when used as a contact in a vacuum interrupter.

We claim as our invention:

1. A method for preparing an electrical contact for use in a vacuum interrupter comprising: disposing a mold of a predetermined configuration and cross-section in a chamber, said mold being comprised of a material selected from a group consisting of copper, steel and ceramics, establishing a vacuum in said chamber, establishing a plasma within a plasma gun, said plasma gun being positioned to discharge into said chamber, preheating the mold wtih the plasma from the gun, feeding predetermined quantities of at least two metals selected from the group consiting of copper, chromium, bismuth and lithium, in a form selected from the group consisting of powders of pure metal and alloys of said metals, into said plasma gun, entraining said metal powders within said plasma for a predetermined time, whereby said metal powders are discharged from said plasma gun entrained in said plasma at a high velocity and impact and solidify as a gas free coating upon said mold and thereafter modifying the quantities of the metals being fed into the plasma gun, whereby, the discharge from the plasma gun impacting and solidifying on said mold as a gas free coating differs in metal composition from the discharge first impacting and solidifying upon the mold.

2. The method of claim 1 in which the metals initially fed into the plasma gun are copper and chromium and the modified feed is predominately chromium.

3. The method of claim 2 in which the mold is spaced from 20 to 60 cm from the gun.

4. The method of claim 1 in which the metals initially fed into the plasma gun are copper, chromium and bismuth and the modified feed is predominately chromium.

5. The method of claim 4 in which the mold is spaced from 50 to 75 cm from the gun.

* * * * *